US006085776A

United States Patent [19]

Hoeptner, III

[11] Patent Number: 6,085,776

[45] Date of Patent: Jul. 11, 2000

[54] WATER SUPPLY SYSTEM

[76] Inventor: Herbert W. Hoeptner, III, 7796 Oak Springs Cir., Gilroy, Calif. 95020

[21] Appl. No.: 09/417,340

[22] Filed: Oct. 13, 1999

[51] Int. Cl.[7] ..... E03B 9/04; E03B 9/14

[52] U.S. Cl. ..... 137/281; 137/301

[58] Field of Search ..... 137/59, 62, 287, 137/288, 301, 302

[56] References Cited

U.S. PATENT DOCUMENTS

| | | | |
|---|---|---|---|
| 4,096,877 | 6/1978 | Arledge, II | 137/281 |
| 4,282,895 | 8/1981 | Young | 137/281 |
| 4,520,836 | 6/1985 | Hutter, III | 137/282 |
| 4,653,521 | 3/1987 | Fillman | 137/281 |
| 4,653,522 | 3/1987 | Fillman et al. | 137/281 |
| 5,261,441 | 11/1993 | Anderson | 137/281 |
| 5,553,637 | 9/1996 | Hoeptner, III | 137/281 |
| 6,003,780 | 12/1999 | Gurries, II et al. | 137/281 |

*Primary Examiner*—George L. Walton
*Attorney, Agent, or Firm*—William W. Haefliger

[57] ABSTRACT

A freeze-resistant water supply system comprising a water outlet or outlets having ON-OFF controls; a water supply line or lines to the outlet or outlets and having a section subjected to cold temperature, and a drain line or lines associated with the outlet or outlets to receive discharge water, and apparatus operatively coupled with the water supply line or lines and drain line for periodically effecting evacuation of water from the supply line section for ultimate flow to the drain line, as a function of the operation of the ON-OFF controls.

7 Claims, 4 Drawing Sheets

(B OPEN
A CLOSED)

(B CLOSED
A CLOSED)

(B CLOSED
A OPEN)

(B OPEN
A OPEN)

WATER SUPPLY SYSTEM

BACKGROUND OF THE INVENTION

This invention relates generally to water supply systems and typically frost-free water supply systems, as at drinking fountains and operable during cold weather conditions; and more specifically, it concerns simple, effective and reliable apparatus that assures freeze resistance of water supplied to one or more drinking water outlets.

The problem of freezing of drinking water lines proximate aboveground fountains has been continual, especially in colder climates. There is great need for improved apparatus that will enable reliable prevention of freezing of water supplied to such drinking fountains. One solution to this problem is described in my U.S. Pat. No. 5,553,637, incorporated herein by reference.

SUMMARY OF THE INVENTION

It is a major object of the invention to provide simple, effective and reliable apparatus that will supply water at one or more outlets during both normal and cold weather conditions, also overcoming the above problems, and to meet the need for freeze prevention.

Basically, a water supply system, in accordance with the invention, comprises:

a) a drinking water outlet or outlets having multiple ON-OFF controls, b) a water supply line or lines to the outlet or outlets, and having a section or sections subjected to cold temperature, and at least one drain line associated with the outlet or outlets to receive discharge water supplied via the outlet or outlets, and c) apparatus including a storage chamber operatively coupled with the water supply line and drain line or lines for periodically receiving water from the water supply line or lines and from the drain line, to prevent freezing of such received water, and for effecting evacuation of water from the storage chamber section for ultimate flow to the drain line or lines, as a function of the operation of the ON-OFF controls.

It is another object to provide water flow lines connected between said A and B valves and said piston, and check valves in communication with said lines and said storage chamber to enable water pressure application from at least one of said lines to said piston when valve A is open and B is closed, when B is open and A is closed, and when both A and B are open.

As will appear, the apparatus advantageously includes a master and slave piston and cylinder unit, driven in response to changes in pressure of water in the supply line.

Yet another object includes the provision of a freeze-resistant water supply system that includes:

a) a water outlet or outlets, b) a pressurized water supply and a drain, c) a water storage chamber and a piston movable in one direction to drive water from said chamber to said drain, and in another direction to enable water flow from the drain into said chamber, d) multiple control valves, including a valve A and a valve B, operatively connected in communication with said water outlet or outlets, with said supply and said drain, and with said chamber and said piston, e) whereby when valve A is open and valve B closed; or valve B is open and valve A is closed, or both valves A and B are OPEN, water flows via A, or B, or both A and B to said outlet or outlets, and water pressure drives said piston to drive water from said chamber to the drain, f) and whereby when both valves A and B are closed, water back-flows from the drain into said storage chamber.

As will appear, the control valves may typically be located underground to prevent freezing thereof, and controls may be located proximate the outlet or outlets and operatively connected with the below ground valves.

Yet another object is to provide water flow lines from A and B to said outlet or outlets, and check valves in communication with said lines and said storage chamber to enable back-flow of water from said lines to said storage chamber when both valves A and B are closed.

A further object is to provide water flow lines connected between A and B and said piston, and check valves in communication with said lines and said storage means to enable water pressure application from at least one of said lines to said piston when valve A is ON and B is OFF, when B is ON or A is OFF, and when both A and B are ON.

An additional object is to provide the piston in the form of a master piston, as to provide a slave piston connected with said master piston and located between the master piston and water received in said chamber.

A yet further object is to provide an improved water supply system that includes:

a) A and B valves and a water pressure supply to A and B, b) lines from A and B to one outlet or outlets, c) at least one drain line, d) a water storage chamber and a pusher operable to enable water flow to and from the chamber, e) lines from A and B to the pusher, f) and valves in said lines, whereby, one of the following, or multiple of the following modes of operation are effective, i) when A is open and B is closed, supply water flows via A to an outlet or outlets, and to the pusher, causing the pusher to drive water from the storage chamber to the drain or drains, ii) w hen A is closed and B is open, supply water flows via B to an outlet or outlets causing the pusher to drive water from the storage chamber to the drain or drains, iii) when both A and B are open, supply water flows via A and B to an outlet or outlets and to the pusher causing the pusher to drive water from the storage chamber to the drain, or drains, iv) when both A and B are closed, the pusher moves slowly to enlarge said chamber and water flows from the drain or drains into said chamber.

These and other objects and advantages of the invention, as well as the details of an illustrative embodiment, will be more fully understood from the following specification and drawings, in which:

DRAWING DESCRIPTION

FIGS. 1–4 are elevations showing modes of operation associated with open and closed conditions of A and B valves.

DETAILED DESCRIPTION

Figure 1:
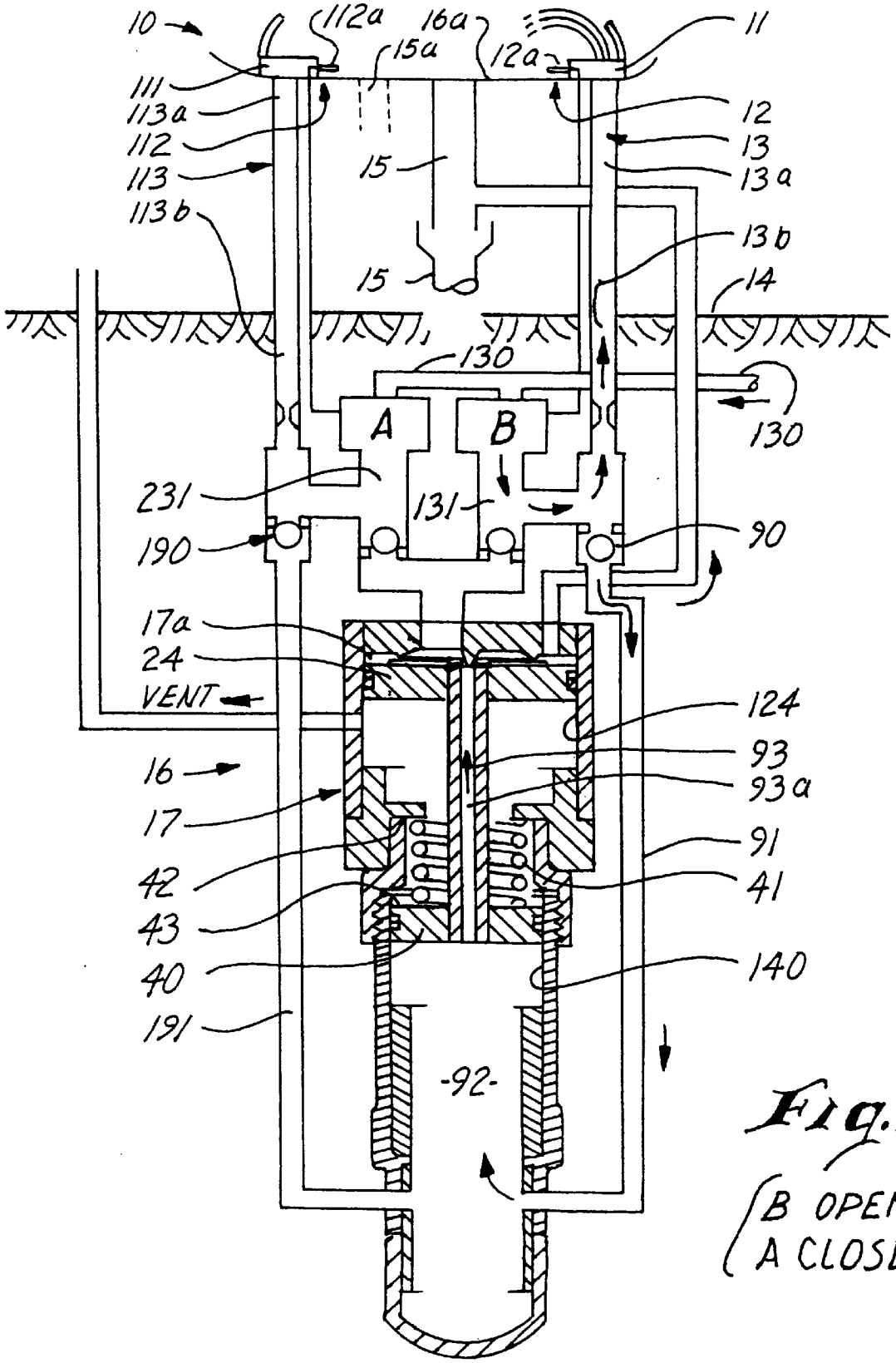

Referring first to FIG. 1, a freeze-resistant water supply system is shown at 10. The system includes a drinking or potable water outlet 11 having an ON-OFF control indicated at 12. The latter may, for example, include a push button 12*a*, associated with or operatively connected with valve B, and which is OFF when released and ON when pushed, to allow supply water to flow under pressure to outlet or bubbler 11. A water supply line 13 is connected to the outlet 11, and typically has a freezable section 13*a* subjected to above ground cold temperature. Section 13*a* is shown, for example, as extending above ground level 14, and may be subjected to freezing temperatures.

Likewise the system includes or may include a second drinking or potable water outlet 111 having an ON-OFF control indicated at 112. The latter may, for example, include a push button 112*a*, which is OFF when released and ON when pushed, to allow supply water to flow via line 130, valve A, and lines 113*b* and 113 under pressure to outlet 111. Water supply line 113 is connected to the outlet 111, and typically has a freezable section 113*a* subjected to cold temperature. Section 113*a* is shown, for example, as extending above ground level 14, and may be subjected to freezing temperatures.

One purpose of the invention is to evacuate water from line sections 13*a* and 113*a* when the controls 12 and 112 are OFF, to prevent freezing of water in those sections 13*a*. Supply line sections 13*b* and 113*b* leading to 13*a* and 113*a* are typically not subjected to freezing temperatures, and may be underground, as shown.

A drain line 15 is associated with the outlet 11 to receive discharge, i.e., of unused water, supplied via the outlet. See also drain 15'. A water basin or bowl 16*a* may collect such discharge water and conduct it to the drain. Drain line 15 is also associated with outlet 111, for the same purpose, but outlet may have a separate drain line indicated at 15*a*.

In accordance with the invention, underground apparatus is provided as generally indicated at 16 to be operatively connected with the water supply line and drain line or lines for periodically effecting evacuation of water from the supply line sections 13*a* and 13*b* and from 113*a* and 113*b*, for ultimate flow to the drain line or lines, as a function of the operation of the ON-OFF controls. Typically, and as seen in FIG. 1, when the PUSH button 12*a* is pushed to ON condition, underground valve B is opened via a suitable connection seen at 212 to supply water that flows via lines 130, 131, and via line 13 and section 13*a* to the outlet 11, which may be a water fountain; and when the PUSH button is released, valve B closes, and water is evacuated from, i.e. flows downward in, the line sections 13*a* for ultimate flow to the drain line. See FIG. 2. Accordingly, the flows in the section 13*a* to 11, and in the evacuation mode, are a periodic function of operation of the ON-OFF control. Prior to flowing to the drain line, water flows from 13 and 13*a* to an underground water storage chamber 17*a* in unit 17, via passages 18–20 and 21 and check valve 50 in passage 19. Also, water drains from line 115 and via line 23 to chamber 17*a*. A piston 24 below chamber 17*a* drops to accommodate enlargement of chamber 17*a*, to receive water.

Figure 2:
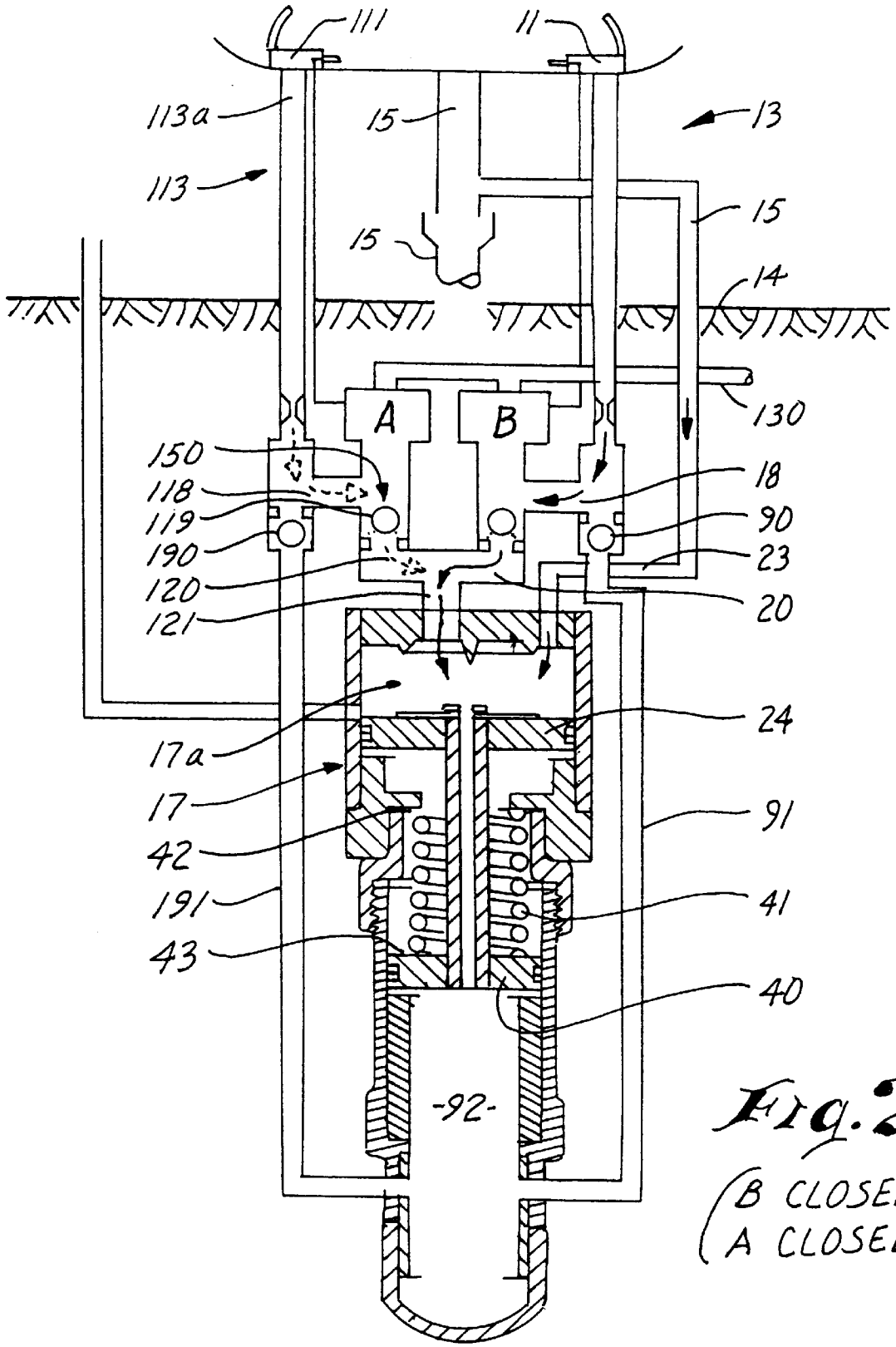

Further, FIGS. 1 and 2 show that apparatus 16 may include a master or pusher piston 40 and slave piston 24 in cylinder unit 17, the pistons driven back and forth, in response to changes in pressure of water in the supply line. In this regard, water pressure in chamber 92 exerts upward force on pusher piston 40 connected to piston 24. For example, in valve B closed or OFF condition, see FIG. 2, water pressure in the supply line 130 is at a pressure $p_1$, which is higher level than the pressure $p_2$ therein when water is flowing to the outlet 11, in valve B open or ON condition.

Figure 3:
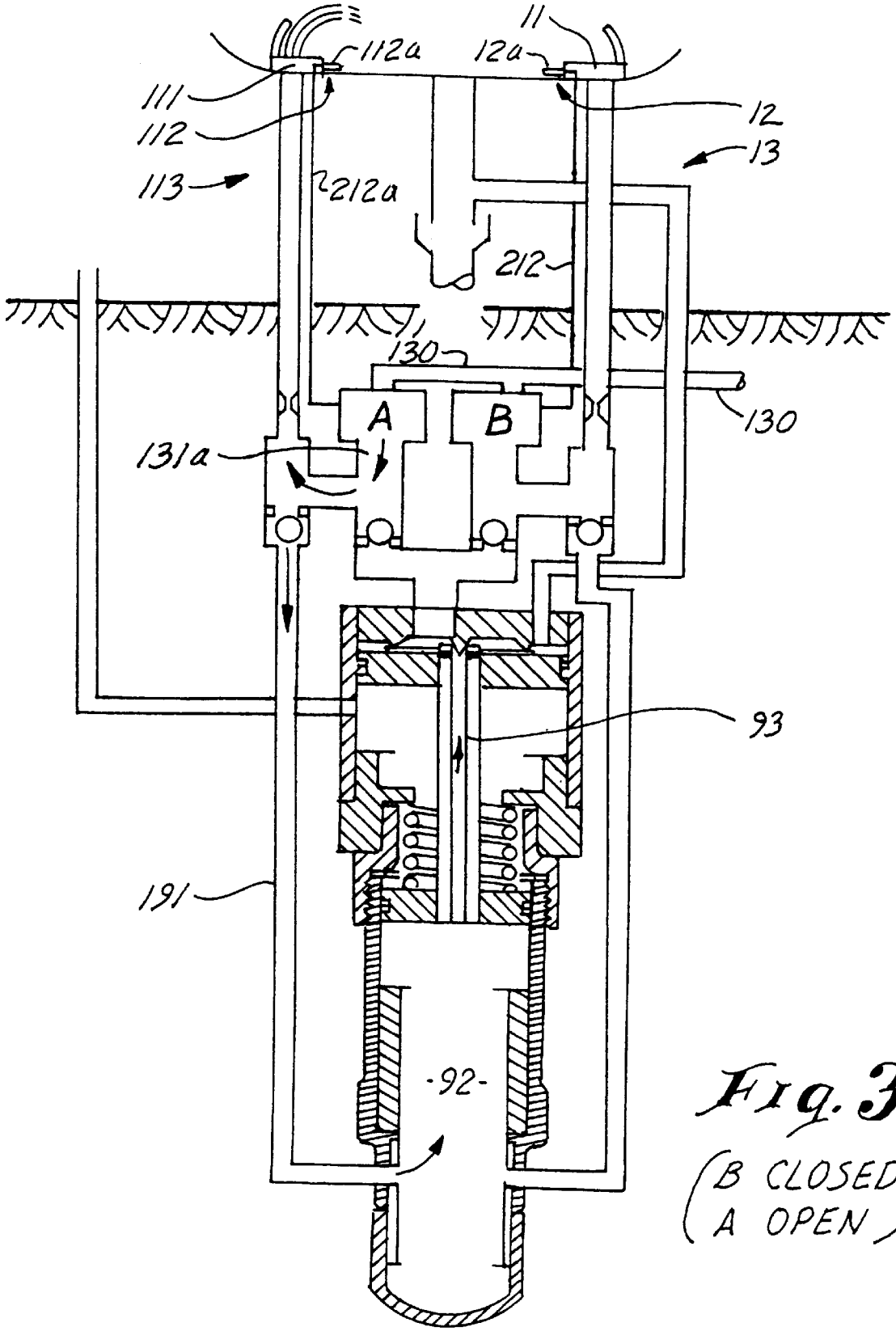

Further and likewise, and as seen in FIG. 3, when the PUSH button 112*a* is pushed to ON condition, underground valve A is opened via suitable connection 212*a* and supply water flows via lines 130, 131 and via line 131*a* and section 113*a* to the outlet 111, which may be a water fountain; and when the PUSH button is released, valve A closes, and water is evacuated from i.e. flows downward in the line section 113*a* for ultimate flow to the drain line. See FIG. 2. Accordingly, the flows in the section 113*a* to 111, and in evacuation mode, are a periodic function of operation of the ON-OFF control. Prior to flowing to the drain line, water flows from 113 and 113*a* to underground water storage chamber 17*a* in unit 17, via passages 118–121, and via check valve 150 in 119. Also, water drains from line 115 and via line 23 to chamber 17*a*. Piston 24 below chamber 17*a* drops to accommodate enlargement of chamber 17*a*.

Figure 4:
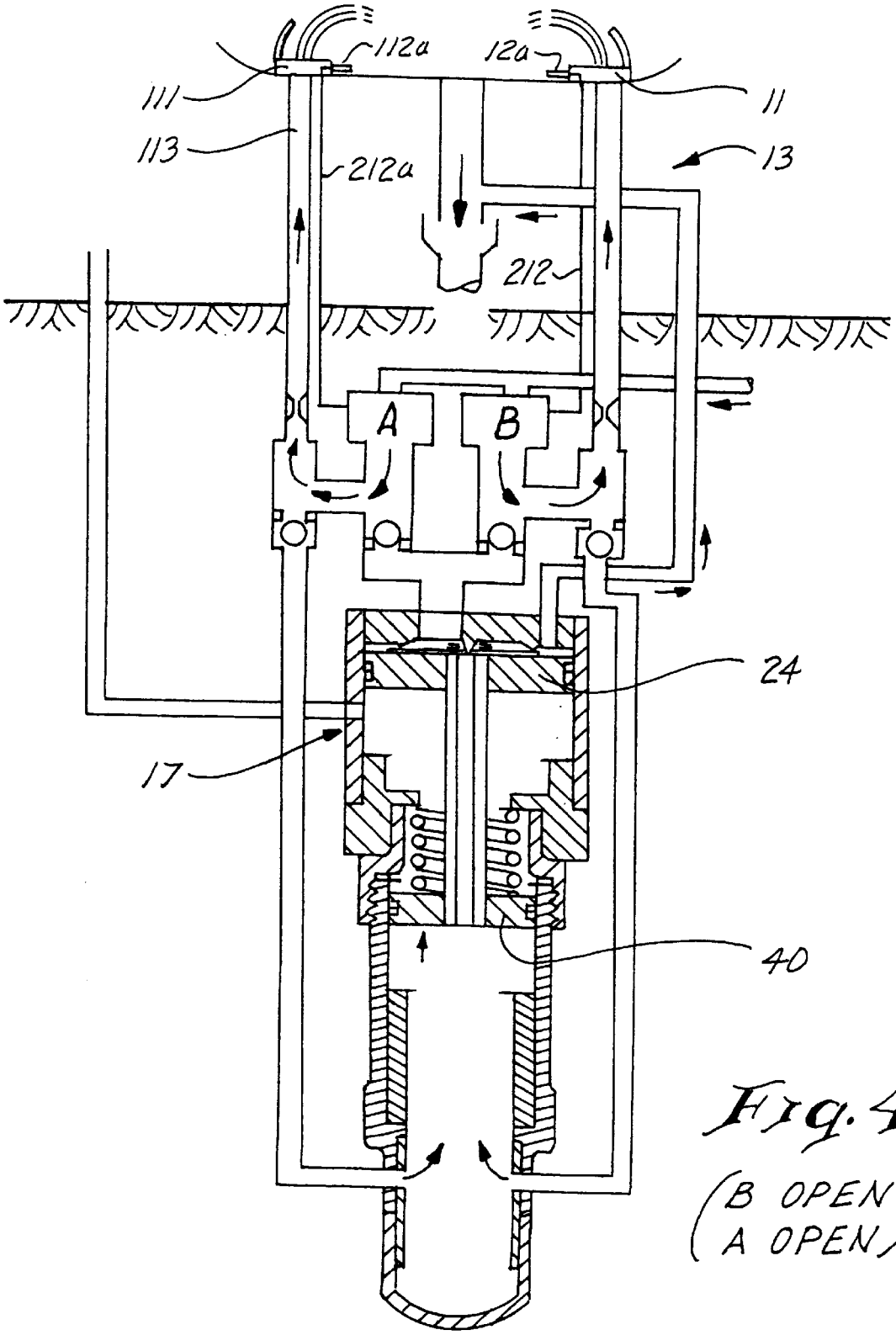

Referring to FIG. 4, it shows water flow when both valves A and B are ON, i.e. push-buttons 12*a* and 112*a* are pushed. Water under pressure flows via open valve A to the bubbler 111; and water under pressure flows via open valve B to the bubbler 11. Also as seen in FIG. 1 water under pressure flows to chamber 17*a* via two paths: the first path including line 131, check valve 90, line 91, lower chamber 92 in unit 16, and a bore 93*a* in tubing 93 that connects upper piston 24 stroking in bore 124 with lower piston 40 stroking in bore 140. In FIG. 2 when both valves A and B are off, bore 93. is sued as a pressure bleeder to relieve pressure from chamber 92, lines 191 and 91, which in turn will allow check valves 190 and 90 to open. Once pressure is relieved, a compression spring 41 seating at 42 and 43 urges piston 40 downwardly, tending to enlarge chamber 17*a*.

The second path includes line 231, check valve 190, line 191, lower chamber 92 in 16, and bore 93*a* and in tubing 93.

In FIG. 1 water also flows via the first path as described, and in FIG. 3, water also flows via the second path, as described.

Accordingly, the water supply system includes:

a) a water outlet or outlets b) a pressurized water supply and a drain, c) a water storage chamber and a piston movable in one direction to drive water from said chamber to said drain, and in another direction to enable water flow from the drain into said chamber, d) multiple control valves, including a valve A and a valve B, operatively connected in communication with said water outlet or outlets, with said supply and said drain, and with said chamber and said piston, e) whereby when valve A is open and valve B closed; or valve B is open and valve A is closed, or both valves A and B are OPEN, water flows via A, or B, or both A and B to said outlet or outlets, and water pressure drives said piston to drive water from said chamber to the drain, f) and whereby when both valves A and B are closed, water back-flows from the drain into said storage chamber.

I claim:

1. In a water supply system the combination comprising a) a water outlet or outlets, b) a pressurized water supply and a drain, c) a water storage chamber and a piston movable in one direction to drive water from said chamber to said drain, and in another direction to enable water flow from the drain into said chamber, d) independently controllable multiple control valves, including a valve A and a valve B, operatively connected in communication with said water outlet or outlets, with said supply and said drain, and with said chamber and said piston, e) whereby when said valve A is open and said valve B closed; or said valve B is open and said valve A is closed, or both said valves A and B are open, water flows via said valve A, or said valve B or both said valves A and B to said outlet or outlets, and water pressure drives said piston to drive water from said chamber to the drain, f) and whereby when both said valves A and B are closed, water back-flows from the drain into said storage chamber, to prevent freezing.

2. The combination of claim 1 including water flow lines from said A and B valves to said outlet or outlets, and check valves in communication with said lines and said storage chamber to enable back-flow of water from said lines to said storage chamber when both said valves A and B are closed.

3. The combination of claim 1 including water flow lines connected between said A and B valves and said piston, and check valves in communication with said lines and said storage chamber to enable water pressure application from at least one of said lines to said piston when said valve A is open and said valve B is closed, when said valve B is open and said valve A is closed, and when both said valve A and B are open.

4. The combination of claim 1 wherein said piston is a master piston, and including a slave piston connected with said master piston and located between the master piston and water received in said chamber.

5. The combination of claim 1 wherein said outlet or outlets are located above ground, and said water storage chamber is located underground.

6. In a water supply system, the combination comprising:

a) independently controllable A and B valves, a water pressure supply being connected to said A and B valves, b) lines from said A and B valves to an outlet or outlets, c) at least one drain line, d) a water storage chamber and a pusher operable to enable water flow to and from the chamber, e) lines from said A and B valves to the pusher, f) and said valves located in said lines, whereby one of the following, or multiple of the following modes of operation are effective:

i) when said valve A is open and said valve B is closed, supply water flows via said valve A, outlet or outlets, and to the pusher causing the pusher to drive water from the storage chamber to the at least one drain line, ii) when said valve A is closed and said valve B is open, supply water flows via said B to an outlet or outlets causing the pusher to drive water from the storage chamber to the at least one drain line, iii) when both A and B are open, supply water flows via said valve A and said valve B to an outlet or outlets and to the pusher causing the pusher to drive water from the storage chamber to the at least one drain line, iv) when both said valves A and B are closed, the pusher moves slowly to enlarge said chamber and water flows from the at least one drain line into said chamber, to prevent freezing.

7. A water supply system, comprising:

a) a drinking water outlet or outlets having multiple ON-OFF controls, b) at least one water supply line connected to said outlet or outlets and having a section or sections subjected to cold temperatures, and at least one drain line associated with said outlet or outlets to receive discharge water supplied via said outlet or outlets, and c) underground apparatus including at least one storage chamber operatively coupled with said at least one water supply line and said at least one drain line for periodically receiving water from said at least one supply line, and from said at least one drain line to prevent freezing of water received in the storage chamber, and for effecting evacuation of water from said storage chamber for ultimate flow to said drain line or lines, as a function of the operation of said ON-OFF controls, d) said apparatus including separate, underground valves in communication with said at least one water storage chamber, which contains a water pressure responsive piston, said valves independently controlled by said ON-OFF controls.

* * * * *